US005791869A

United States Patent [19]

Lee

[11] Patent Number: 5,791,869

[45] Date of Patent: Aug. 11, 1998

[54] NOISE KILLING SYSTEM OF FANS

[75] Inventor: Seungbae Lee, Gwacheon, Rep. of Korea

[73] Assignee: Samsung Electronics Co., Ltd., Suwon, Rep. of Korea

[21] Appl. No.: 597,126

[22] Filed: Feb. 6, 1996

[30] Foreign Application Priority Data

Sep. 18, 1995 [KR] Rep. of Korea ..... 1995-30449

[51] Int. Cl.[6] ..... F04D 29/66

[52] U.S. Cl. ..... 415/119; 126/247

[58] Field of Search ..... 415/118, 119; 126/247

[56] References Cited

U.S. PATENT DOCUMENTS

| | | | |
|---|---|---|---|
| 5,082,421 | 1/1992 | Acton et al. | 415/118 |
| 5,141,391 | 8/1992 | Acton et al. | 415/119 |
| 5,343,713 | 9/1994 | Okabe et al. | 381/71 |
| 5,391,053 | 2/1995 | Pla et al. | 415/119 |
| 5,415,522 | 5/1995 | Pla et al. | 415/119 |
| 5,423,658 | 6/1995 | Pla et al. | 415/119 |
| 5,558,298 | 9/1996 | Pla et al. | 415/119 |

*Primary Examiner*—John T. Kwon

*Attorney, Agent, or Firm*—Burns, Doane, Swecker & Mathis, L.L.P.

[57] ABSTRACT

Mounted on the body of a fan blade is a micro-electro mechanical system which includes at least one thin silicon film forming an integrated circuit, and an actuator connected to the circuit for generating vibrations. If used as a noise-killing system, the actuator generates vibrations which offset (reduce) unstable air flows along the blade body. If used in a heat exchanger to improve the heat exchange effect, the system generates vibrations which amplify the unstable air flow, e.g., to amplify turbulence and vortexes.

4 Claims, 3 Drawing Sheets

NOISE KILLING SYSTEM OF FANS

FIELD OF THE INVENTION

The invention relates to a technology for inducing air flow adjacent to the circumferential portion of blades constituting various fans to reduce noises, and particularly, to a noise killing system for controlling secondary flow, leading edge separation flow and vortex shading thereby remarkably reducing the noise level and improving the performance of fans.

BACKGROUND OF THE INVENTION

A fan is a rotary blade machine, which delivers kinetic energy to air or gas at some pressure continuously, with a head increase to recover the losses in the system concerned. The trend for the development of fans is summarized as low noise with a high performance, especially in the home appliance business. Therefore, there has been developed a method for reducing the aerodynamic noise of a fan or a turbo mechanism by an optimum design through studies of the shapes and materials of blades. A typical technology using the method is disclosed in Korean Patent Application No. 95-12561, which was filed on May 16, 1995. That method concerns an optimization design of the shapes and materials of blades based on the acoustic similarity in order to reduce the aerodynamic noises of fans. In particular, the fan is supposed to have an optimum blade cross-sectional shape by changing the angle of the blades. But, the method relates to a planar design of the blade cross-section of an axial flow fan, so the degree of noises to be reduced is limited.

In this respect, there was proposed Japanese Patent Laid-open No. Hep-5-312196 disclosing a typical noise killing apparatus to reduce the noises of a wide band range of an axial fan.

As shown in FIG. 1, the apparatus is constituted as part of the axial fan. The axial fan 7 is provided with a trunk part **7*b* and blade parts 7*a* and rotationally driven so as to feed air. A detecting sensor 8 provided at a specific position on the negative pressure side blade face of the blade part, detects variations of air flow along the negative pressure side blade face, and outputs a first signal. A computation processing device internally mounted in the trunk part 7*b* outputs a second signal processed from the signal of the detecting sensor 8. An air flow control actuator 9 controls air flow so as to cancel the variation of air flow based on the second signal of the computation processing device. The actuator 9 is provided at the specific position on the lower stream side of the detecting sensor 8**.

Therefore, the velocity sensor 8 can detect the fine turbulent components on the blade face. The first signals indicating the turbulent flow components are inputted into the computation processing device. The computation processing device itself adjusts the phase and output gain of every frequency and outputs the second signals to an amplifying portion constituted as an outputting device, in which the adjustment of the phase and output gain is determined based on the transfer coefficient of (i) the air flow control actuator 9 and the velocity sensor 8, (ii) the movement of the turbulent flow on a boundary layer from the velocity sensor 8 to the air flow control actuator 9, and (iii) the compensation of the transfer function indicating the amplification and the phase of the turbulent flow on the boundary layer when the air flow control actuator 9 is positioned on the negative pressure blade face.

Therefore, the turbulent flow moved to the position of the air flow control actuator is detected, and a vibration having an amplitude contrary to the phase of the turbulent flow on the boundary layer is generated by means of the air flow control actuator. Then, the turbulent flow can be reduced to near zero. Consequently, the excessive deformation of the blades is reduced, and the level of the noises radiated from the blade face is decreased.

But, the active noise control technology must take into consideration the positions of the detecting sensor and the vibration actuator because their positions are different from each other. Thus, the time required for transferring the detected turbulent flow signal to the air flow control, actuator and the increasing or decreasing of the amplitudes of the detected signals are very important. The detecting sensor and the air flow control actuator are relatively large in size, so they have to be designed with consideration of a time constant. Also, a data base is required for the amplifying related to all modes of the various turbulent flow components and thus a more complex computation processing device is necessary.

Therefore, it is preferable to remove the distance between the detecting sensor and the air flow control actuator and miniaturize their sizes, thereby preventing the mode amplifying of turbulent flow components in advance.

In light of these points, it is preferable that the micro-electron mechanical system controls the flow generated around the periphery of the blade cross-section to reduce the blade passage frequency noises induced by the performance characteristics of the s-hysteresis due to the planar design of the blade cross-section, a secondary flow and a vortex shedding by the irregular change of a periodic blade loading, a leading edge separation at the leading edge of a blade and a narrow band noise due to the flow separation of the blade negative pressure cross-section as well as the noise of a wide band by the turbulent flow. Also, the removal of air flow having a high energy and turbulent flow is preferable, thereby improving the fan operational performance.

An object of the invention is to provide a noise killing system comprising a micro-electro mechanical system mounted on a predetermined position of various fans and for controlling the air flow around the periphery of blades thereof, thereby remarkably reducing the noise level and improving the performance of fans.

Another object of the invention is to provide a noise killing system comprising a micro-electro mechanical system for controlling the air flow around the periphery of blades, which is provided with a logic circuit, a sensor and an actuator integrally constructed in the form of a thin film.

Another object of the invention is to provide a noise killing system comprising a micro-electro mechanical system mounted on the leading edge of a blade or the negative pressure blade face of an axial flow fan and a propeller fan to control the flows of the leading edge separation and the vortex shading.

Still another object of the invention is to provide a noise killing system comprising a micro-electro mechanical system to control the secondary flow generated on the blades of a centrifugal fan and a sirocco fan.

Still another object of the invention is to provide a noise system comprising a micro-electro mechanical system to control the secondary flow generated on a tongue-shaped portion of the blades of a cross fan.

SUMMARY OF THE INVENTION

In accordance with the invention, a noise killing system comprises a micro-electro mechanical system which includes: a sensor for detecting turbulent flows of the pressure fluctuation caused by the wind velocity according to the rotating of a blade and outputting the corresponding detecting signals; a first amplifying portion for amplifying the signals from the sensor; a computation processing portion for receiving the signals from the first amplifying portion and computing the unstable pressure or velocity modes of turbulent flows and generating control signals to offset the modes; a second amplifying portion for amplifying flow control signals from the computation processing portion; and a vibration actuator, so called "a transducer or an oscillator", for being vibrated at a predetermined frequency of the control signals from the second amplifying portion, in which the micro-electro mechanical systems mounted on the predetermined position of a blade of various fans in order to optionally control flows around the periphery of the blades.

The micro-electronic-mechanical system including a sensor, a computation processing portion, and a vibration actuator is integrally constructed in a compact size in the form of a thin film and mounted on the predetermined position of the blade face of various fans, such as an axial fan, a centrifugal fan, a cross fan, etc. and a turbo mechanism, so that it controls the secondary flow, the leading edge separation and the vortex shading to offset local pressure fluctuations on the blade face, which generates noises of the narrow or wide band, with the pressure variations having a phase contrary thereto, thereby remarkable reducing the noise level and improving the operational performance of fans.

BRIEF DESCRIPTION OF THE DRAWINGS

The above objects and other advantages of the invention will become more apparent from the preferred embodiment described in detail with reference to the accompanying drawings, in which.

DETAILED DESCRIPTION OF THE PREFERRED EMBODIMENTS

Figure 1:
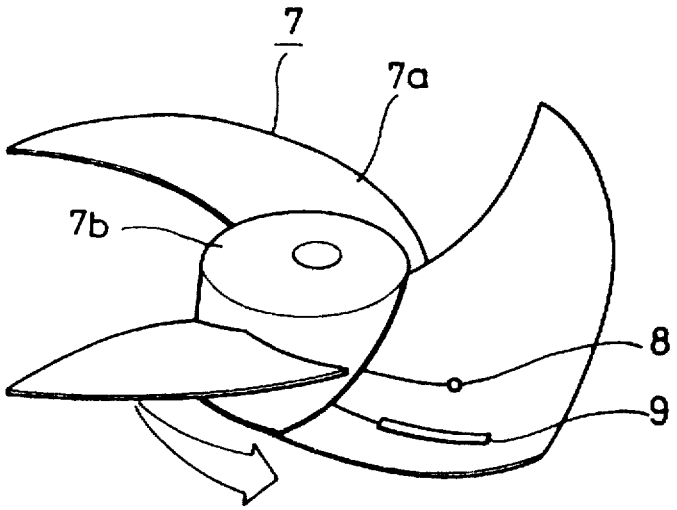
FIG. 1 (PRIOR ART)
FIG. 1 is a perspective view showing an axial fan, on the blades of which a system for reducing the noise level of a narrow or wide band frequency according to a prior art is mounted.
Figure 2:
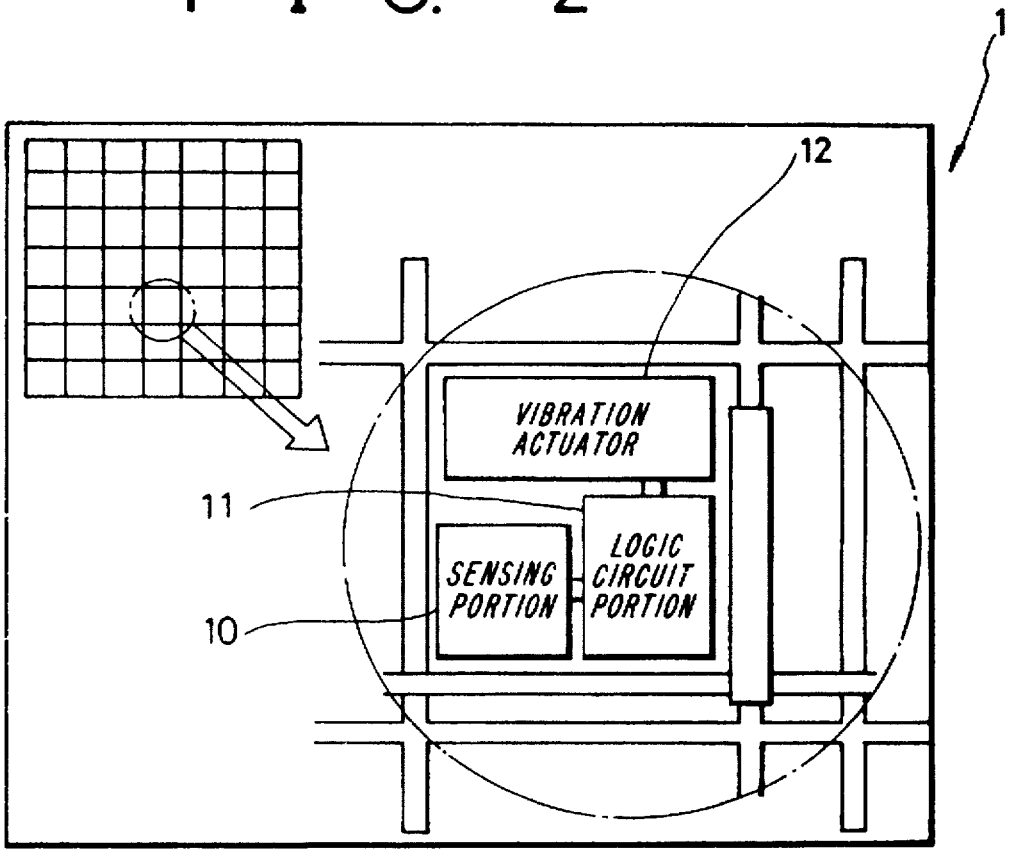
FIG. 2 is a sectional view showing the micro-electro mechanical system according to the invention.

As shown in FIG. 2, a noise killing system comprises a micro-electro mechanical system 1 including: a sensing portion 10 for detecting a pressure at a predetermined position on a fan blade; a logic circuit portion 11 constituted as a computation processing portion; and an actuator 12 for being vibrated according to signals from the logic circuit portion 11. The micro-electro mechanical system 1 is made of a silicon semiconductor in a very small size in the form of a thin film chip. Also, the micro-electro mechanical system 1 is formed into an integrated circuit to have a higher space integration and a smaller time constant.

Figure 3:
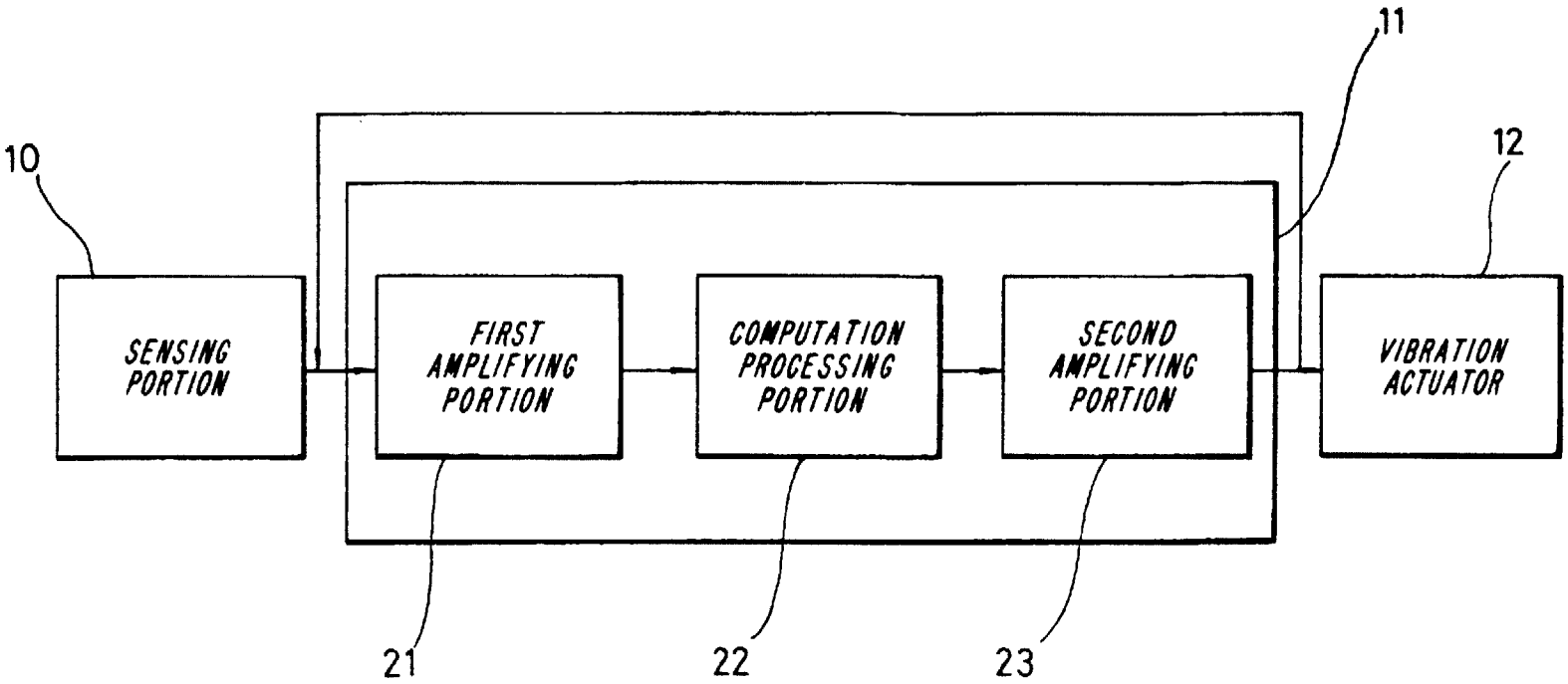
FIG. 3 is a block diagram showing the configuration of the micro-electro mechanical system according to the invention.

In other words, as shown in FIG. 3, the sensing portion 10 includes a pressure sensor for detecting the pressure or flow fluctuations caused by wind velocity changes around a predetermined position or the periphery of blade faces during the operating of a fan. Then, the sensing portion 10 outputs detected signals to a logic circuit portion 11.

The logic circuit portion 11 includes a first amplifying portion 21 for amplifying the signals from the sensing portion 10; a computation processing portion 22 for processing the signals from the first amplifying portion 21 according to a system program; and a second amplifying portion 23 for amplifying the signals from the computation processing portion 22. Herein, the computation processing portion 22 has its own system program, which receives the pressure or flow fluctuation signals detected by the sensing portion 10 and analyzes most unstable mode signals to generate the harmonic signals having a reverse phase contrary thereto. Namely, the most unstable mode signals are amplified to enable the computation processing portion 22 to analyze the unstable pressure propagated from a downstream to an upstream on a blade face as well as to obtain a self correlation function. As a result, the computation processing portion 22 analyzes the frequency of the time shift on the pressure fluctuations.

Therefore, the computation processing portion 22 generates signals to offset the unstable pressure or velocity modes. The computation processing portion 22 may perform a feedback control for adjusting the output gain and phase of frequencies against the unstable signal modes. Also, the computation processing portion 22 may be adapted to a system program based on a fuzzy logic theory, so that it can analyze continuous signals from the sensing portion 10 and perform a flow control to reduce the unstable pressure or flow fluctuations variation caused by the signals.

Thus, the computation processing portion 22 applies control signals to the second amplifying portion 23 in accordance with the analyses of the unstable modes including the pressure or flow variations around the blades. The second amplifying portion 23 amplifies the control signals to have a predetermined gain. The amplified signals are then sent to the vibration actuator 12 to be vibrated to offset the unstable modes. The vibration actuator 12 includes either a small magnet oscillator or a thin film transducer which is driven by a weak electric current.

Figure 4:
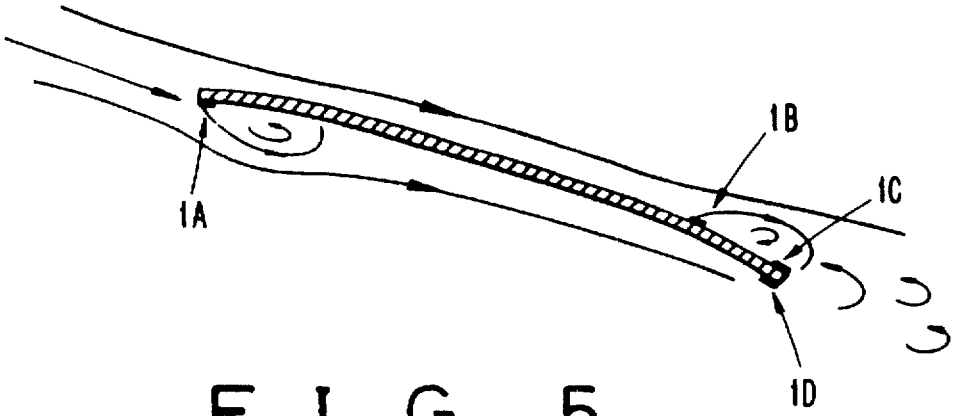
FIG. 4 is a view showing the mounting of the micro-electro mechanical system on the predetermined position of a blade face adapted to an axial fan or a propeller fan according to the principal of the invention.

As shown in FIG. 4, the micro-electro mechanical system 1 can be applied to either an axial fan or a propeller fan. The fans generate discrete noises and narrow band noises due to the leading edge separation on the pressure surface of a blade edge, the flow separation on the negative pressure surface and the vortex shading. Therefore, in order to control the turbulent flow according to the present invention, the micro-electro mechanical system 1A is mounted on the upstream portion of a blade and for enabling the vibration actuator 12 to be vibrated to offset the leading edge separation at the upstream portion of the blade. The micro-electro mechanical system 1B is mounted on the negative pressure surface of the blade to control a secondary flow of the flow separation on the boundary layer. The micro-electro mechanical system 1C or 1D is mounted on the upper or lower end, respectively, of the blade to control the vortex shading flow. Accordingly, the flow loss is minimized to reduce the noise level, remarkably.

Figure 5:
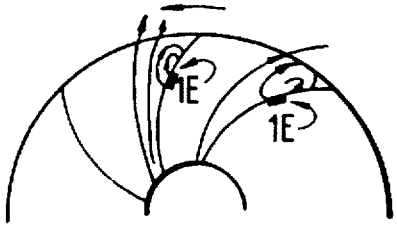
FIG. 5 is a view showing the mounting of the micro-electro mechanical system on the predetermined position of a blade face adapted to a centrifugal fan or a sirocco fan according to the principal of the invention.

As shown in FIG. 5, the micro-electro mechanical system 1E can be adapted to either a centrifugal or sirocco fan. The fans cause flow loss and an increasing of the noise level by the secondary flow due to the flow separation on the negative pressure surface which is positioned on the boundary layer. The secondary flow induces S-hysteresis characteristics due to the rotation stall in a blade cross-section which the flow passage is decreased starting from one point occurring the flow on the side of the blade. Thus, the micro-electro mechanical system 1E is mounted on the starting point to prevent the performing of the unstable modes, thereby minimizing the flow loss and reducing the noise level, remarkably.

Figure 6:
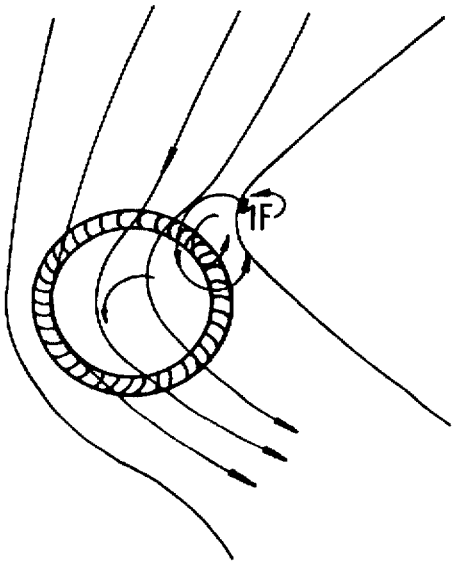
FIG. 6 is a view showing the mounting of the micro-electro mechanical system on the predetermined position of a blade face adapted to a cross fan according to the principal of the invention.

As shown in FIG. 6, the micro-electro mechanical system 1F can be adapted to a cross fan mostly used in an air conditioning apparatus. The fan generates the secondary flow at a tongue-shaped portion thereof. The secondary flow adversely affects the performance of the fan, while it is a cause of the noise incresement. Therefore, the micro-electro mechanical system 1F is mounted adjacent to the tongue-shaped portion, so that both the amplitude of the turbulent flow and the magnitude of the secondary flow would be reduced, thereby minimizing the flow loss and reducing the noise level, remarkably.

Furthermore, the micro-electro mechanical system 1 may be properly distributed on a plurality of positions of the blades to control various unstable flow, so that the flow separation is reduced and a high energy turbulent component is removed, thereby improving the performance of fans and reducing the noise level, remarkable.

On the other hand, the invention can omit a sensing portion and a computation processing portion from a micro-electro mechanical system and use only a vibration actuator operated at a predetermined frequency. Those vibration actuators would be mounted at the positions around the periphery of a blade which cause the unstable modes of fans, the positions being found out by an optimum design technology according to a prior art, thereby controlling the flows around the periphery of a blade to prevent the amplifying of the unstable mode.

Also, the invention can be accomplished in a manner that instead of a micro-electro mechanical system a plurality of projections having a predetermined mass could be regularly arranged at the positions around the periphery of a blade which cause the unstable modes, thereby obtaining the same effects as those of the micro-electro mechanical system, i.e., a so-called "a passive flow noise killing method".

The prevention is also applicable to a fan blade of a heat exchanging apparatus for promoting thermal transfer. However, in that case the unstable modes would be deliberately amplified, rather than prevented from being amplified. That is, a micro-electro mechanical system would be mounted on a predetermined position for generating a turbulent flow and a vortex shading flow of a blade, so that it can amplify the unstable modes, thereby promoting the thermal transferring in a heat-exchanging apparatus.

As described above, the noise power in various fans is approximately proportional to the value obtained by multiplying the square of the positive pressure increasing value at the front and rear portions of the fan by the square of the flow rate. And, if the leading edge separation happens, it tends to change the indices of the positive pressure and flow rate. However, a micro-electro mechanical system detects generally unstable modes so as to control the flow with a predetermined pressure being generated thereby. Substantially, the invention is adapted to an outdoor fan of an air-conditioner having the noise level of 50 dB. As a result, the invention reduced the noise level of over 10 dB. Also, the invention minimizes the interval of a time shift, so that the vibration actuator can be operated without being affected by the time constant.

What is claimed is:

1. A fan blade including a blade body and a noise killing apparatus mounted on the blade body at a predetermined position thereon; the noise-killing apparatus comprising a micro-electro mechanical system including a thin silicon film chip disposed at the position and forming: an integrated circuit, and an actuator disposed at the position and operated by the circuit for generating vibrations offsetting unstable air flow modes produced along the blade body.

2. The fan blade according to claim 1 wherein the chip further comprises a sensing portion for detecting turbulent flow along the periphery of the blade body, the integrated circuit including a logic circuit connected to the sensing portion and the actuator, the logic circuit including a computation processing portion for analyzing signals from the sensing portion representative of turbulent flow and supplying signals to the actuator to generate vibrations offsetting the turbulent flow.

3. A fan blade including a blade body and at least one noise killing apparatus mounted on the blade body at a predetermined fixed position thereon for continuously generating vibrations of a fixed frequency to offset unstable air flow modes produced at such location.

4. A fan blade for a heat exchanger, the fan blade including a blade body and a micro-electrical mechanical system including a thin silicon film chip forming: an integrated circuit, and an actuator operated by the circuit for generating vibrations increasing unstable air flow modes produced along the blade body.

* * * * *